United States Patent [19]

Ekhoff

[11] Patent Number: 4,941,293

[45] Date of Patent: Jul. 17, 1990

[54] FLEXIBLE ROCKING MOUNT WITH FORWARD PIVOT FOR POLISHING PAD

[76] Inventor: Donald L. Ekhoff, 2600 Day Rd., Gilroy, Calif. 95020

[21] Appl. No.: 307,693

[22] Filed: Feb. 7, 1989

[51] Int. Cl.[5] ..... B24B 41/00

[52] U.S. Cl. ..... 51/168; 51/281 SF

[58] Field of Search ..... 51/168, 281 SF, 281 R

[56] References Cited

U.S. PATENT DOCUMENTS

| | | | |
|---|---|---|---|
| 2,633,008 | 3/1953 | Tocci-Guilbert | 51/168 |
| 2,767,527 | 10/1956 | Tocci-Guilbert | 51/168 |
| 2,810,239 | 10/1957 | Burleigh | 51/168 |
| 4,393,628 | 7/1983 | Ottman et al. | 51/281 |
| 4,586,296 | 5/1986 | Saunders | 51/281 |
| 4,592,169 | 6/1986 | Klievoneit et al. | 51/118 |
| 4,736,475 | 4/1988 | Ekhoff | 51/104 |

*Primary Examiner*—Roscoe V. Parker

*Attorney, Agent, or Firm*—Thomas Schneck

[57] ABSTRACT

A flexible mounting for an abrasive planar pad onto a carrier rotated about a first axis of rotation. The carrier has a face side perpendicular to the axis of rotation and a resilient, frustroconical sleeve affixed to the face for rotation therewith. The tapering walls of the sleeve define opposed intersecting axes forming a virtual gimbal with the gimbal center or pivot point in close proximity to the planar surface of the pad. The forward position of the gimbal center and its proximity to the planar surface allows rocking of the pad to follow any misalignment of a planar article to be abraded, yet neutralizes those forces which urge pivoting of the abrasive pad relative to the planar article.

10 Claims, 2 Drawing Sheets

FIG._1. (PRIOR ART)
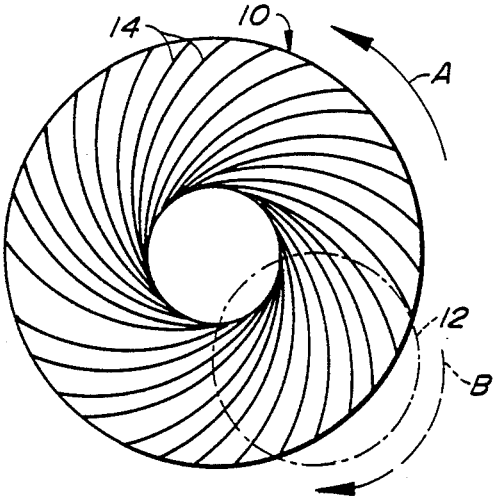
FIG._7.
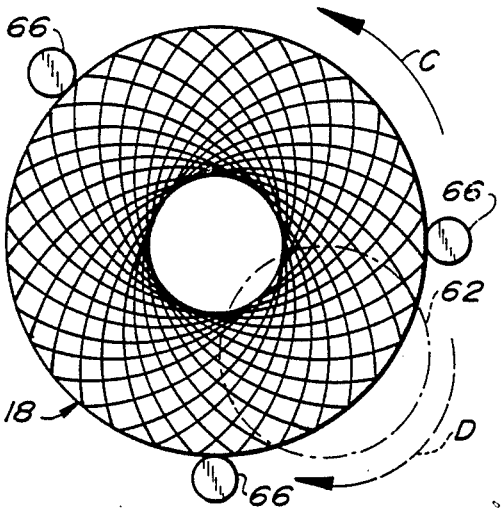
FIG._3.
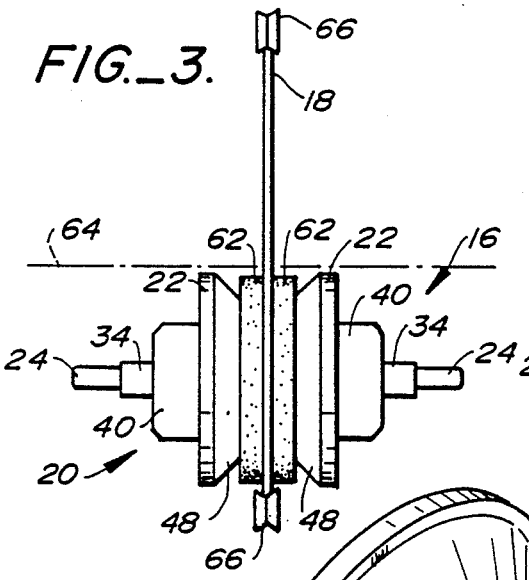
FIG._4.
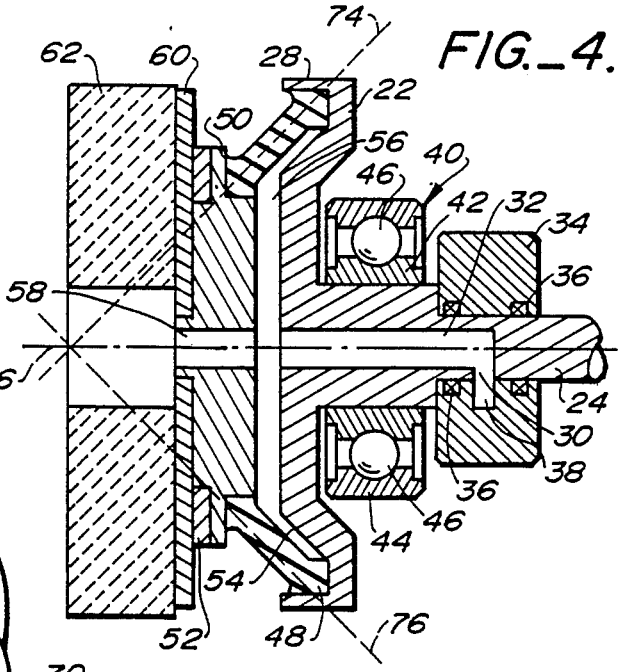
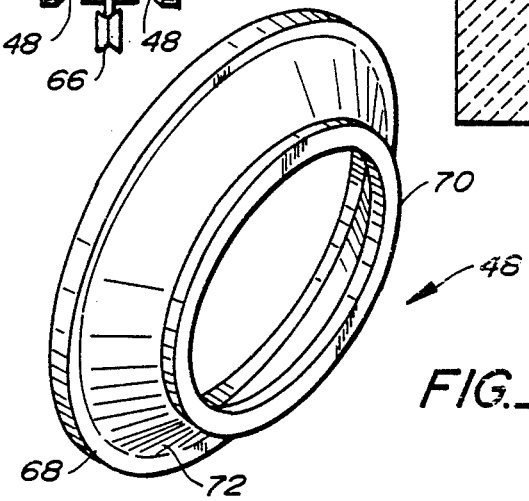
FIG._5.

FLEXIBLE ROCKING MOUNT WITH FORWARD PIVOT FOR POLISHING PAD

DESCRIPTION

1. Technical Field

The present invention relates generally to surface finishing of planar articles and more particularly to apparatus for supporting a planar abrading member used in finishing the surface of magnetic disks and the like.

2. Background Art

Winchester disk drives include a flat, annular, rigid disk coated with a magnetic material, and a magnetic head assembly which reads and writes digital information in the magnetic material of the disk. While a number of materials, including plastic, have been used as base materials for the rigid disk, virtually all rigid disks in present day use are made of aluminum In oxide technology, the surfaces of the aluminum are coated with an epoxy-based matrix having magnetically sensitive particles. In thin-film technology, alternatively, nickel is applied by spattering or plating to form a magnetically sensitive coating.

A trend in disk manufacturing is to pack ever greater amounts of data on a single rigid disk, which implies increasing the bit density on the disk. The bit density of a disk is inversely proportional to the size of the magnetic domains that store individual bits, so that as the magnetic domains decrease in size the bit density increases. To decrease the size of the magnetic domains, the magnetic coating on a disk surface should be as thin as possible. Increased density requires a thinner magnetic coating on a smoother aluminum surface. Consequently, the trend toward higher density disks must be accompanied by a tightening of manufacturing tolerances with regard to topographical irregularities of a finished disk.

Abrading machines for disk-shaped surfaces are known. U.S. Pat. No. 4,736,475 to Ekhoff teaches a surface finishing apparatus having an elongated abrasive tape, much like a tape of sandpaper, which is wound from one spool to another spool during contact with a rotating disk. U.S. Pat. No. 4,592,169 to Klievoneit et al., on the other hand, discloses a disk grinder having oppositely faced grinding wheels to contact the opposed surfaces of a plurality of disks. One of the grinding wheels is loosely mounted to a shaft to accommodate self-alignment of the grinding wheel for parallel orientation with the plurality of disks and another grinding wheel. A rocking effect is produced which resembles motion which would be produced by a gimbal mounting for the grinding wheel.

A method of finishing the opposed sides of a single rigid disk is taught in U.S. Pat. No. 4,586,296 to Saunders. A first finishing pad is urged against one side of a rotating disk, while a second finishing pad is urged against the opposite side. Neither finishing pad extends from the inside diameter to the outside diameter of the disk, so that the method reduces the useful surface area of the disk. In comparison, U.S. Pat. No. 4,393,628 to Ottman et al. utilizes rotating pads which finish the entirety of a rotating disk. The Ottman et al. apparatus includes a pneumatic bellows section into which air is introduced to apply a predetermined polishing force and to permit self-adjustment of a pad should the disk shift in orientation.

A problem which has received attention is that of maintaining proper disk-to-pad relation if the disk shifts during rotationally driving or polishing of the disk. Some prior art tools utilize rigid, massive mounting structures for the disks and for the polishing pads to prevent shifting. Such structures are cumbersome and expensive. Klievoneit et al. and Ottman et al. teach structures which permit finishing pads to pivot, or "rock", so as to match shifting of a disk. However, permitting freedom of movement of a finishing pad may promote unwanted rotation of the pad surface relative to the disk, such rotation being the result of drag and other forces related to the two contacting surfaces. FIG. 1 illustrates a rigid magnetic disk 10 which is caused to rotate in a counterclockwise direction, as indicated by arrow A. A finishing pad 12, driven in a clockwise direction shown by arrow B contacts the surface of the magnetic disk 10. The finishing pad has a tendency to "trip" at its left, or leading side. That is, the leading side of the pad 12 remains in contact with the magnetic disk 10 but the right or trailing side of the finishing pad has a tendency to lift off the magnetic disk to some degree. In practice, pads which are mounted to a holder that permits pad rocking normally do not experience an actual lifting of the trailing side of the pad off of the magnetic disk. Instead, the drag and other such forces are manifested in an improper distribution of force loading over the pad-to-disk contact area.

FIG. 1 shows a plurality of radial scratches 14 produced by abrasive particles of the finishing pad 12. The distance between scratches 14 and the direction of the scratches is a function both of the relative rates of rotation of magnetic disk 10 and the finishing pad and of the directions of rotation. In any case, the single-direction scratch pattern is induced by the uneven loading of the pad. That is, the leading edge of the finishing pad does a greater amount of cutting than the trailing edge.

Moreover, the graph of FIG. 2 illustrates the irregularities of disk topography that result from the "tripping" of the finishing pad. FIG. 2 is an optically obtained texture profile plotting disk radius on the x-axis and voltage on the y-axis. The plotted voltage is a function of the height of a finished disk surface FIG. 2 shows that disk height is greatest at the outside diameter and the inside diameter of the disk, with a valley at the disk center. As noted above, topographical irregularities are detrimental to efforts to increase bit density. Such irregularities also increase the chance of disk head crash wherein the head assembly scrapes the surface of the magnetic coating, destroying the data stored on the disk.

It is an object of the present invention to provide an apparatus and finishing method for a disk or the like which is not subject to forces, such as drag, that tend to cause pivoting of a finishing pad surface relative a disk to be finished.

DISCLOSURE OF THE INVENTION

The above objects have been met by an apparatus and method for finishing a disk by which drag is reduced, or neutralized, by permitting controlled rocking of an abrasive surface about a pivot point in close proximity to the disk surface to be finished. An abrasive finishing pad is mounted to a planar holder elastically connected to a spinner mechanism or driven shaft by a frustroconical rubber sleeve. The apex of the cone forms the rocking center and is coaxial with the shaft axis. By placing the rocking center or pivot point substantially forward, but slightly behind the finishing surface of the pad, future wear of the pad will permit the rocking center to continue to be near the finishing surface.

Typically, a finishing pad for a magnetic disk has a circular finishing surface and is comprised primarily of an abrasive grit in a porous matrix of polyvinyl formal rigid sponge. A lubricant is channeled to the polishing surface during operation. The present invention is a mounting apparatus for the finishing pad and includes a rigid carrier having a face side and an axis of rotation defined by a driven shaft that is perpendicular to the finishing surface. The elastomeric frustroconical sleeve is fixed to the face side of the carrier by the annular base of the frustroconical sleeve. The conical angle of the sleeve is preferably 45° relative to the axis of rotation. The sleeve is made of a resilient material to provide a limited amount of rocking about an extended point which would be the apex of the sleeve cone. The conical sleeve is mounted in a reverse orientation with the finishing pad connected to the smaller diameter end of the sleeve. The sleeve is dimensioned such that the rocking center of the sleeve is located at a forward location slightly inward of the finishing surface of the pad. Operation of the finishing process causes wear of the pad. The rocking center is at the average thickness of the useful portion of the pad.

An advantage of the present invention is that the finishing pad is permitted to follow the surface of the magnetic disk which may shift slightly during rotational drive or during the grinding process. Another advantage is that because the rocking center is near the finishing surface, this ability to follow the magnetic disk is not susceptible to forces which urge pivoting of the finishing pad relative to the surface of the disk, i.e. undesired rocking. Torque is equal to magnitude of the forces urging pivot times the moment arm of those forces. Here, the moment arm of the drag force is negligible. Consequently, the pad is not likely to rock relative to the disk surface, and the risk of topographical irregularities is reduced. A third advantage is that because the finishing pad remains parallel to the magnetic disk, abrasion takes place both at the trailing and the leading edges of the finishing pad. Consequently, a uniform cross-hatch pattern of scratches is produced. It has been discovered that this cross-hatch pattern is beneficial to proper disk operation.

BRIEF DESCRIPTION OF THE DRAWINGS

FIG. 1 is a front view of a possible scratch pattern on a magnetic disk that could be created by a finishing pad mounted in accord with the prior art.

FIG. 3 is a side view of a finishing method in accord with the present invention.

FIG. 4 is a side sectional view of a mounting apparatus of FIG. 3.

FIG. 5 is a perspective view of a gimbal mount of FIG. 4.

FIG. 7 is a frontal view of the magnetic disk of FIG. 3, illustrating the pattern of scratches.

BEST MODE FOR CARRYING OUT THE INVENTION

Figure 2:
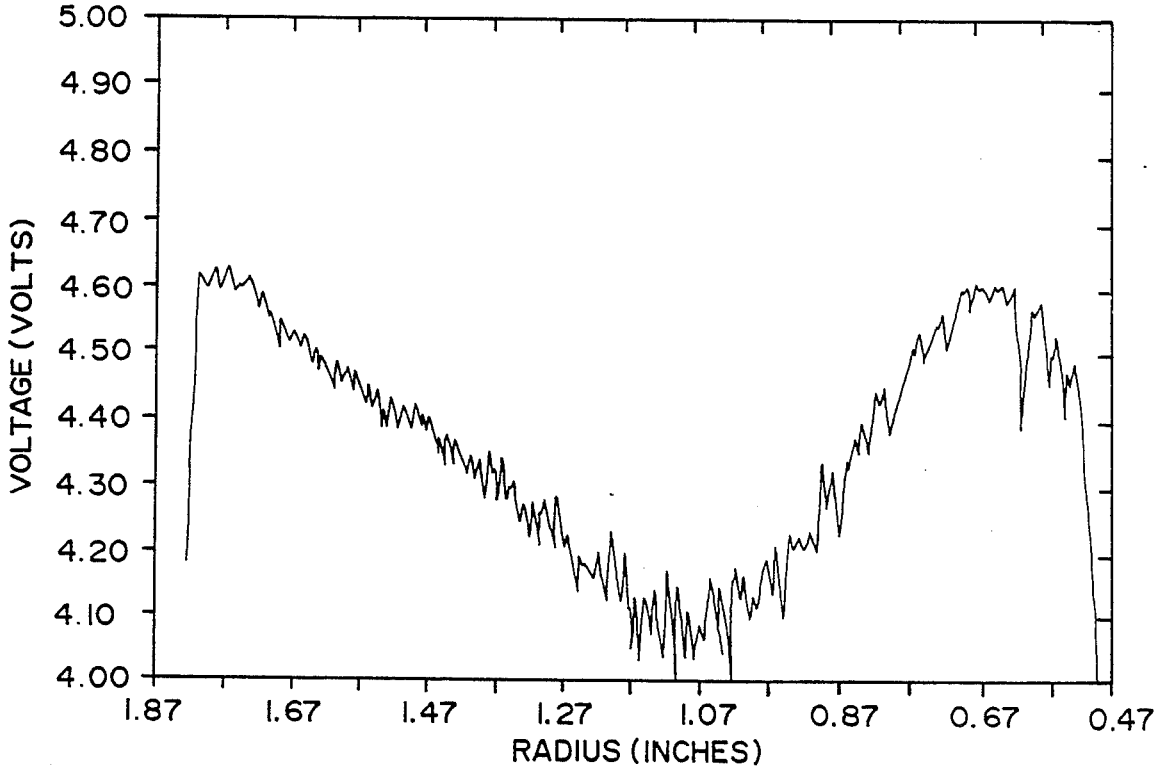
FIG. 2. (PRIOR ART)
FIG. 2 is a texture profile illustrating the topography of the magnetic disk of FIG. 1.

With reference to FIGS. 3 and 4, a first mounting apparatus 16 is shown for finishing one side of a magnetic disk 18. A second mounting apparatus 20 mirrors the first mounting apparatus for finishing the opposite surface of the magnetic disk 18. While the disk 18 is referred to as a magnetic disk, the present invention may be utilized to finish other planar surfaces. In fact, the disk 18 may be the aluminum substrate which must be finished prior to application of the magnetic coating in which information is stored. Thus, in the manufacture of a rigid magnetic disk, the mounting apparatus 16 is used first to finish the surface of the aluminum substrate and used again after application of the magnetic coating. The term "finishing" is meant to include abrading, polishing or grinding operations.

The structure will be explained with reference to the first mounting apparatus 16, but the second mounting apparatus 20 is identical to the first, both in structure and function. The apparatus includes a carrier 22 having a driven shaft 24. The shaft 24 is rotatably driven about an axis of rotation 26 by a motor, not shown. Alternatively, the carrier 22 may be rotated about axis 26 by a belt which contacts the outer circumference 28 of the carrier. The carrier includes an inlet 30 leading to an axial bore 32 for the channeling of liquid therethrough.

A rotary coupling 34 is seated on the shaft portion 24 of the carrier 22. Bearing members, such as ball bearings, are received in races 36 which join the rotary coupling 34 to the shaft portion. A fluid passageway 38 is aligned with the inlet 30 of the carrier and is in fluid communication with a source, not shown, of water miscible oil, a lubricant commonly used in finishing the surface of a magnetic disk.

Forward of the rotary coupling 34 is a bearing assembly 40 having a radially inward portion 42 which rotates with the carrier and having a radially outward portion 44 which is fixed to a stationary structure. The radially inward portion 42 is permitted to rotate relative to the stationary portion 44 by a race containing ball bearing members 46.

The carrier 22, rotary coupling 34 and the bearing assembly 40 may be made of stainless steel. The outer circumference 28 of the carrier 22 has a diameter of 2.25 inches, but this dimension is dependent upon the size of the magnetic disk 18 to be finished.

A frustroconical elastomeric sleeve 48 is snugly fit to the face of the carrier 22. The sleeve is made of a tough, resilient material, preferably silicon rubber. The sleeve has a large diameter base end fit to the carrier 22. Ideally, the wall of the sleeve is at a 45° angle to the axis of rotation 26 defined by the shaft 24. As will be explained more fully below, opposed walls of the sleeve define intersecting axes 74 and 76 at an axially outward point which would be the apex of a cone if the wall of the sleeve were extended. A typical outer diameter at the sleeve base is 2.25 inches, while a typical inner diameter at the frustrum is 1.25 inches, with a wall length of slightly more than 0.5 inches at the outside of the sleeve.

The small diameter end of the cone 48 snugly receives a magnet support member 50. The magnet support member is made of stainless steel and may be adhesively bonded to the sleeve. The forward end of the magnet support member is recessed to correspond in size and shape to a magnet 52. Optionally, the magnet 52 may be bonded to the support member 50. The magnet support member is spaced apart from the face 54 of the carrier 22 to define a chamber 56 therebetween. The magnet support member is annular in shape, having a bore 58 which is aligned with the axial bore 32 of the carrier 22.

A stainless steel backing member 60 fixed to a finishing pad 62 is held to the remainder of the assembly by the magnetic force provided by the magnet 52. In this manner, the finishing pad 62 can be removed and replaced as the pad wears. The finishing pad 62 is of the type commonly used in the art, and may be composed primarily of fine silicon carbide or green silicon carbide abrasive grit in a porous matrix of polyvinyl formal rigid sponge. During a finishing operation, such a pad, sometimes referred to as a PVA pad, must be continuously furnished with a liquid vehicle. The finishing pad 62 is brought into contact with a surface of the disk 18 by a force within a range of 5 psi and 10 psi. After finishing approximately 100 disks, the finishing surface of a pad 62 should be refurbished. Ideally, the pad does not wear more than 0.005–0.01 inch before it is refurbished. In any case, total excursion should not be more than 0.125 inch before the finishing pad 62 is replaced with a new finishing pad.

In operation, as seen in FIG. 3, a magnetic disk 18 is rotated about an axis of rotation 64 by grooved wheels 66 contacting the outer edge of the disk, while the opposed finishing pads 62 are rotated about an axis of rotation defined by the shafts 24 parallel to axis 64. Referring to FIGS. 4 and 5, the rubber sleeve 48 acts as a bladder to at least partially define the pressure of the finishing pad 62 against a surface to be finished, yet the sleeve is able to rock so as to yield when necessary to prevent damage to the disk and to maintain alignment with the plane of the disk. The cylindrical base of the sleeve is joined to the face 54 of the carrier 22. A second cylindrical portion 70 receives the magnet support member 50. The tapering wall 72 is long enough to permit flexing but short enough to resist twisting. During a finishing operation, lubricant collects within the chamber 56 between the face of the carrier and the surfaces adjacent the face, but does not fill the chamber. Some gas exists in the chamber so that rocking can occur upon gas compression. Thus, fluid pressure to the axial bore 32 of the carrier 22 affects the pressure of the liquid in the chamber 56 against the sleeve 48 and the magnet support member 50.

As noted above, opposed lines in the tapering wall 72 of the sleeve 48 define intersecting axes 74 and 76 that permit a degree of freedom of finishing pad movement which has been termed "rocking". Ideally, each axis is at a 45° angle to the axis of rotation 26 of the carrier 22, and the axes of rocking 74 and 76 defined by the tapering wall intersect at the average location of the finishing surface of the pad 62. The intersecting axes may vary in angle in the range of 42° to 48°. Moreover, the intersection of axes defined by the tapering wall 72 should not be at the finishing surface of a pad which has not been used. The intersection of axes produces motion mimicking a gimbal and should be at the midpoint of the usable portion of the finishing pad. This usable portion is typically 0.125 inches so that the critical gimbal center is about 0.0625 inches from the surface of a new finishing pad. These dimensions, however, are not critical.

Figure 6:
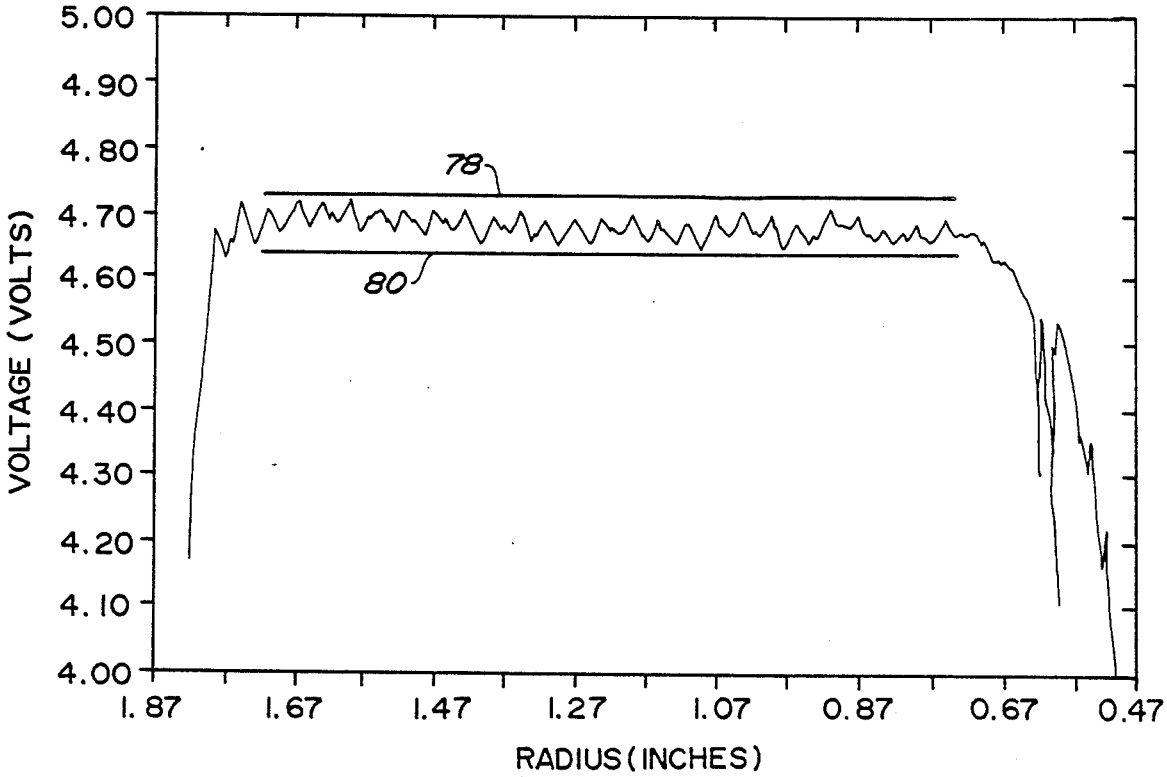
FIG. 6 is a texture profile showing the topography of a magnetic disk which was finished using the method of FIG. 3.

In summary, the mounting apparatus 16 projects a virtual gimbal center for pad movement, with the gimbal center being on the spinner axis 26 and in close proximity to the contact surface of the pad against the magnetic disk 18. Placing the gimbal center at or near the finishing plane defined by contact of the pad 62 with the magnetic disk 18 maintains the finishing pad 62 in parallel relationship with the magnetic disk. FIG. 6 is a texture profile of a disk surface after finishing utilizing a mounting apparatus 16. The disk surface is that of 3.5 inch magnetic disk, but the texture profile is along a radius of the disk. The recording portion of the magnetic disk from its outside diameter to the inside diameter stays within the range indicated by horizontal lines 78 and 80, and is without potentially harmful topographical irregularities. Consequently, it is possible to finish an aluminum substrate or a magnetic coating on an aluminum substrate to form a smooth surface. Smoothness is desirable since the magnetic coating can then have a uniform thinness and since a smooth coating is less likely to promote lubricant migration.

The oscillations seen in FIG. 6 represent the scratch pattern of FIG. 7. The finishing pad 16 is maintained in parallel relationship with the magnetic disk 18 so that scratching takes place at both the trailing and leading ends of the pad. Preferably, the magnetic disk 18 is rotated at a rate ten times that of the finishing pad and is rotated in a direction opposite of that of the pad, as indicated by arrows C and D. In this manner, a cross hatch pattern of scratches is produced. This pattern promotes even distribution of the lubricant on which a disk head rides. The pattern of FIG. 7 is not an actual pattern, the angle formed by intersecting scratches is, in actuality, less than one degree.

The twist-resistive sleeve described above is not limited to finishing of rigid magnetic disks. The apparatus and method may also be used in finishing silicon wafers and the like.

I claim:

1. A mounting apparatus for a finishing member of the type frictionally contacting a planar surface to be finished, comprising, a rotatable carrier having a face and having an axis of rotation substantially perpendicular to a planar surface to be finished, and an annular elastomeric sleeve coaxial with said axis of rotation and coupled to said face of the carrier for supporting a finishing member on a forward side of said annular sleeve opposite to the face of the carrier, said annular member defining a rocking center on said axis of rotation for rocking of said finishing member, said rocking center being beyond the axial extent of said annular sleeve at said forward side.

2. The apparatus of claim 1 wherein said annular sleeve is a frustroconical member having a taper from larger diameter to smaller diameter in a direction from said face of the carrier toward said forward side.

3. The apparatus of claim 2 wherein opposed sides of said frustroconical sleeve define lines which intersect in a point on said axis of carrier rotation and wherein the angle between each line and said axis of carrier rotation is in the range of 42° to 48°.

4. An abrading apparatus for disks and the like comprising, means for mounting a disk and for rotating said disk about a first axis of rotation, a rotatable carrier having a second axis of rotation parallel to said first axis, means for driving said carrier about said second axis of rotation, and means for attaching an abrasive member to said carrier for rotation therewith, said abrasive member having a flat surface perpendicular to said second axis of rotation, said flat surface being a finishing surface disposed axially outwardly from said carrier for contact with said disk, said attaching means including a virtual gimbal center in close proximity to said finishing surface, said virtual gimbal mount being axially outward from said carrier.

5. The apparatus of claim 4 wherein said attaching means is a resilient frustroconical member having a base coupled to said carrier.

6. The apparatus of claim 5 wherein said frustroconical member has an annular wall with opposed wall surfaces tapering at an angle in the range of 42° to 48° relative to the second axis of rotation.

7. The apparatus of claim 4 further comprising a second carrier and second means for attaching an abrasive member corresponding to said first, said abrasive members disposed to finish opposed surfaces of said disk.

8. A method of finishing a disk comprising, rotating a disk about a first axis of rotation, contacting a flat surface of a rotating finishing member to a surface of said disk in a manner allowing rocking of the finishing member, providing a center of rocking for said finishing member proximate to said flat surface of the finishing member, and rotating said finishing member about a second axis of rotation parallel to said first axis.

9. The method of claim 8 further defined by contacting a second finishing member to a surface of said disk opposite to said disk surface contacting the first finishing member, said first and second finishing members having symmetric centers of rocking.

10. The method of claim 8 further defined by flexibly coupling the finishing member to the first axis of rotation.

* * * * *